United States Patent [19]

De Geus

[11] 4,312,087

[45] Jan. 26, 1982

[54] FABRIC CASING FOR ELASTIC CORES SUCH AS CUSHIONS AND THE LIKE

[76] Inventor: Donald De Geus, Saanehoegsvaegen 4, S-26300 Hoeganaes, Sweden

[21] Appl. No.: 109,456

[22] PCT Filed: Nov. 23, 1978

[86] PCT No.: PCT/SE78/00083

§ 371 Date: Jul. 24, 1979

§ 102(e) Date: Jul. 24, 1979

[87] PCT Pub. No.: WO79/00315

PCT Pub. Date: Jun. 14, 1979

[30] Foreign Application Priority Data

Nov. 24, 1977 [SE] Sweden ..... 7713315

[51] Int. Cl.[3] ..... A47G 9/00

[52] U.S. Cl. ..... 5/490; 5/497

[58] Field of Search ..... 5/470, 471, 490, 496, 5/497; 297/218, 219, 223, 226

[56] References Cited

U.S. PATENT DOCUMENTS 1,469,523 10/1923 McGarvey ..... 5/490
3,490,810 1/1970 Putnam ..... 297/218
3,695,691 10/1972 Putnam ..... 297/218

*Primary Examiner*—Roy D. Frazier
*Assistant Examiner*—Alexander Grosz
*Attorney, Agent, or Firm*—Wigman & Cohen

[57] ABSTRACT

A fabric casing for elastic cores is provided, which cores have two opposite faces, such as cushions or pads, especially for stuffed furniture and the like. According to the invention the casing comprises two fabric pieces (2, 3) of different character with respect of for instance color and/or pattern, each of said pieces covering one of the core faces, said pieces being joined together all along the circumference of the core (1) in a plane (4) at half-way distance between the core faces, said pieces jointly projecting in said plane laterally outwardly a distance (f) exceeding said half-way distance to thus form a circumferential collar (5) whose peripheral edge (7) is reduced in length for instance by stitching or is resiliently reducible in length using, for example, an elastic ribbon to thus make said peripheral edge shorter than the core circumference in said plane (4), whereby the collar (5) can be pulled over variably onto one or the other of the core faces so as to cover core side surfaces between said faces, so that always the very same fabric is exposed to view on (i) said side surfaces and (ii) one of said faces.

2 Claims, 3 Drawing Figures

FABRIC CASING FOR ELASTIC CORES SUCH AS CUSHIONS AND THE LIKE

The present invention refers to a fabric casing for elastic cores which have two opposite faces, such as cushions or pads, especially for stuffed furniture and the like.

Various types of such fabric casings are previously known but hitherto they have not allowed an easy change of the character or appearance of a cushion but in such cases the casing must be made exchangeable as a whole and/or adapted for being turned inside out. It has now been found, however, that by a particular location of stitch rows and fabric pieces around a cushion core there can be provided possibilities for an easy change of the appearance of the cushion from one fabric to another. This is achieved according to the invention by the casing comprising two fabric pieces of different character of for instance color and/or pattern, each of said pieces covering one of the core faces, said pieces being joined together all along the circumference of the core in a plane at half-way distance between the core faces, said pieces jointly projecting in said plane laterally outwardly a distance exceeding said half-way distance to thus form a circumferential collar whose peripheral edge is reduced in length for instance by stitching or is resiliently in length using, for example, an elastic ribbon, to thus make said peripheral edge shorter than the core circumference in said plane, whereby the collar can be pulled over variably onto one or the other of the core faces so as to cover core side surfaces between said faces, so that always the very same fabric is exposed to view on (i) said side surfaces and (ii) one of said faces.

The ability of pulling over the cushion collar which is achieved by means of the present invention now for the first time allows an easy way to provide for a change of the appearance of not only separate cushions but also entire pieces of furniture, particularly pieces of furniture such as sofas, armchairs and the like in that the seat pads as well as the back pads easily can be brought to change appearance entirely.

Figure 1:
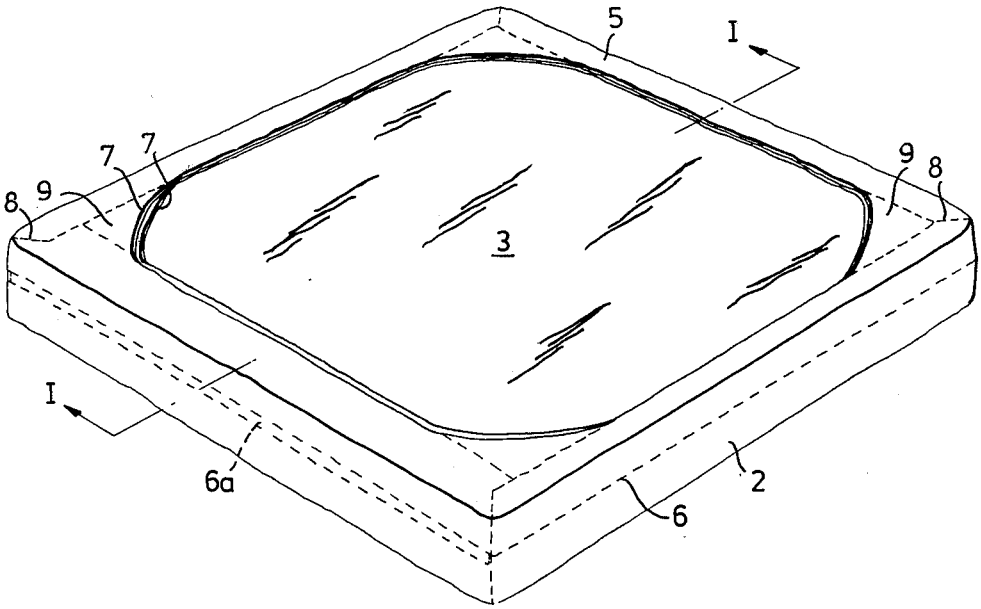
Figure 2:
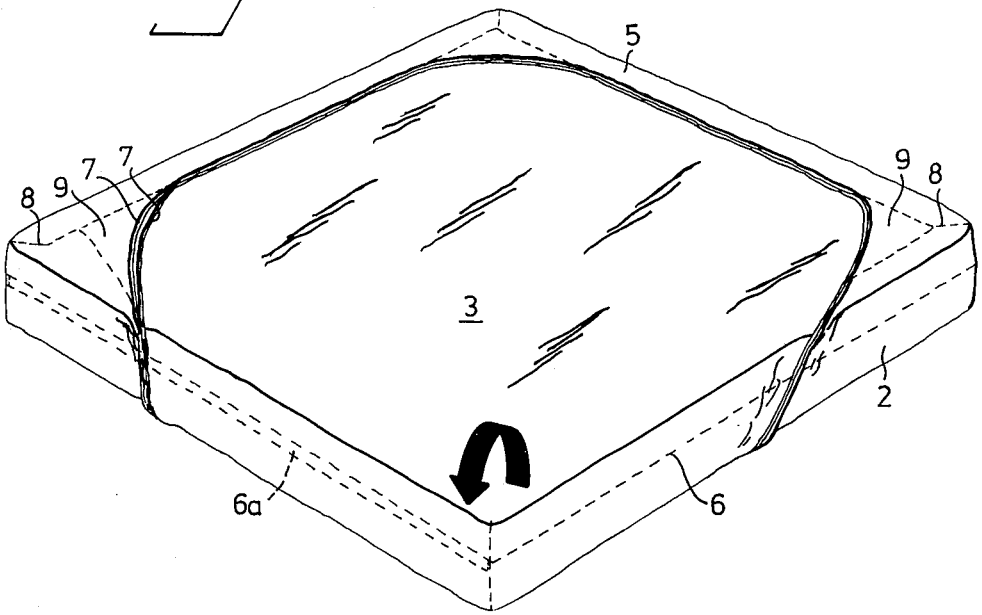
Figure 3:
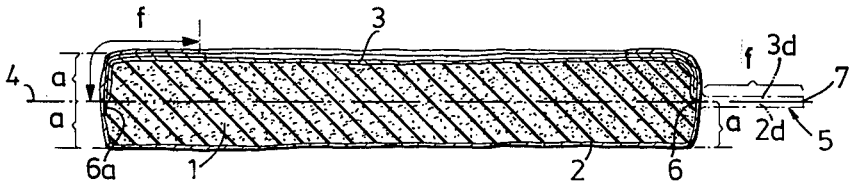

By way of example the invention will be further discribed below with reference to the accompanying drawing, in which FIG. 1 is a perspective view with the face of a cushion according to the invention turned upwardly, on which the cushion is adapted to rest and onto which the collar has been pulled over, FIG. 2 is a perspective view similar to FIG. 1 but it illustrates the initial steps of pulling over the corner piece of the collar closest to the viewer towards the opposite face of the cushion, and FIG. 3 is a cross-sectional view through the cushion according to FIG. 1 along the line I—I of said Figure.

As is evident from the drawing the cushion casing according to the invention is adapted to be mounted on a suitable shaped cushion core 1 of any known material such as polyether, foam rubber or the like or to be filled with a bulk material such as so-called flock of for instance polyether. The casing according to the invention consists of two fabric pieces, 2, 3, which are arranged on opposite faces of the cushion and of different character such as color and/or pattern. In a central plane 4, i.e. in a plane at half-way distance between the core faces, the two fabric pieces 2, 3, are joined together all along the circumference of the cushion core 1, and said pieces are jointly projecting in said plane laterally outwardly a distance f beyond said circumference. In fact, the size of said distance f exceeds the distance a between the respective opposite cushion face and the central plane 4 such that a peripheral "flange" or collar 5 is formed.

Thus said collar 5 consists of the portions *2d*, *3d* of the two opposite fabric pieces 2, 3 projecting beyond the cushion core and said portions are preferably joined together by stitching closely to the cushion core by a stitch row 6 in said central plane. Along one of the sides of the cushion said stitch row 6 might include a sliding fastener *6a*. The projecting fabric portions *2d*, *3d* are also suitably joined together by stitching at their free outer edge 7 by means of a stitch row, omitted however at the cushion side which is to be provided with the slide fastener *6a*, if desired.

According to the invention, the free peripheral edge 7 of the collar 5 is provided with stitched corner reductions 8 and/or corner filling panels 9 such that the free peripheral edge 7 of the collar 5 is of a shorter total length than the total circumferential length of the cushion. Owing thereto the collar 5 can be turned over the side edges of the cushion onto one or the other of the core faces while utilizing the resiliency of the core 1, so that the collar then will remain on the cushion face in question and the casing is kept stretched. Of course, it is obvious that in case the core 1 has insufficient resiliency to allow an easy pulling-over of the collar 5 as aforementioned the free edge 7 of the collar 5 instead can be made elastically contracted, for instance by an elastic ribbon introduced into an edge hem, which has not been illustrated in the drawing, however.

What we claim is:

1. A fabric casing for elastic cores having two faces and a plurality of side surfaces, comprising:

first and second different fabric pieces, each one of said pieces covering one of the faces of said core;

said first and second different fabric pieces being joined together along the entire circumference of said core in a plane halfway distant between said core faces;

said first and second pieces each overlapping the other a distance exceeding said halfway distance between said core faces to thus form a circumferential collar; and said circumferential collar having a peripheral edge shorter than the circumference of said core, whereby said collar can be pulled over said either one of said two core faces so as to cover said side surfaces between said faces such that the same one of said first and second different fabric pieces is exposed to view on one of said faces and said side surfaces of said core.

2. The fabric casing of claim 1, wherein said peripheral edge of said circumferential collar is shortened by means of stitches.

* * * * *